US005271741A

United States Patent [19]

Saito et al.

[11] Patent Number: 5,271,741

[45] Date of Patent: Dec. 21, 1993

[54] FEMALE SOCKET CONTACT

[75] Inventors: Hitoshi Saito; Osamu Sugiyama; Masutoshi Hashimoto; Kazuo Nagata, all of Shizuoka, Japan

[73] Assignee: Yazaki Corporation, Japan

[21] Appl. No.: 936,398

[22] Filed: Aug. 31, 1992

Related U.S. Application Data

[63] Continuation-in-part of Ser. No. 658,331, Feb. 20, 1991, Pat. No. 5,158,485.

[30] Foreign Application Priority Data

Feb. 21, 1990 [JP] Japan ..... 2-15629[U]

[51] Int. Cl.[5] ..... H01R 13/187

[52] U.S. Cl. ..... 439/843; 439/851

[58] Field of Search ..... 439/842–850, 439/856, 857, 861, 851

[56] References Cited

U.S. PATENT DOCUMENTS 2,738,485 3/1956 Batcheller ..... 439/849
2,814,025 11/1957 Wade et al. ..... 439/845
3,370,265 2/1968 Berg ..... 439/843
4,415,221 11/1983 Inoue et al. ..... 439/849
4,880,401 11/1989 Shima et al. ..... 439/843

FOREIGN PATENT DOCUMENTS 3244939 3/1984 Fed. Rep. of Germany ..... 439/849

*Primary Examiner*—David L. Pirlot
*Attorney, Agent, or Firm*—Venable, Baetjer, Howard & Civiletti

[57] ABSTRACT

Disclosed is a female socket contact of the type having a female electrical contact section adapted to mate with a corresponding male contact and a resilient contact plate provided in the female electrical contact section. Thin-walled sections are respectively formed in opposing side walls constituting the female electrical contact section so as to provide on the inner surface of the side walls recesses for inner-space enlargement, and the end edges of the resilient contact plate are respectively positioned in the recesses for inner-space enlargement, thereby providing a large resilient contact pressure. The resilient contact plate can be formed separately from or integrally with the socket contact.

7 Claims, 4 Drawing Sheets

FEMALE SOCKET CONTACT

CROSS REFERENCE TO RELATED APPLICATION

This application is a continuation-in-part of application Ser. No. 658,331, filed Feb. 20, 1991. now U.S. Pat. No. 5,158,485.

BACKGROUND OF THE INVENTION

1. Field of the Invention

This invention relates to a male and a female contact used for connecting wire harnesses and, in particular, to an improvement in a female socket contact.

2. Description of the Related Art

A known female socket contact has a wire connection section and a box-type or a cylinder-type female electrical contact section which is adapted to mate with a corresponding male contact. Provided in the female electrical contact section is resilient contact plate formed of a highly resilient metal different from the material of this section. The resilient contact plate has at each side end of its base portion an engagement section, which respectively engages an engagement hole provided in each side wall of the electrical contact section.

In the above structure, the resilient contact plate is formed in such a width as will allow it to be positioned between the two side walls of the female electrical contact section. That is, the width of the resilient contact plate is smaller than that of the electrical contact section by the thickness of the side walls and the clearance between this resilient contact plate and the side walls. Thus, the width of the resilient contact plate in the above structure is restricted as compared with that of the electrical contact section. This makes it difficult to obtain a large resilient contact pressure.

SUMMARY OF THE INVENTION

This invention has been made in view of the problem mentioned above. It is accordingly an object of this invention to provide a female socket contact in which the resilient contact plate in the electrical contact section has a relatively large width, thereby improving the performance of the resilient contact plate.

In order to achieve the above object, this invention provides a female socket contact comprising a female electrical contact section having opposing side walls and adapted to mate with a corresponding male contact, and a resilient contact plate provided in the female electrical contact section and having end edges, the female electrical contact section having thin-walled sections respectively formed in the opposing side walls thereof, the above-mentioned thin-walled sections respectively providing in the side walls recesses for inner-space enlargement, and the end edges of the resilient contact plate being respectively positioned in the above-mentioned recesses for inner-space enlargement.

In the structure of this invention described above, the resilient contact plate of the female socket contact can be made as large as possible within the limited space of the female electrical contact section, so that a large resilient contact pressure can be obtained. With its thin-walled sections left in the side walls, this socket contact structure can provide a sufficient level of strength.

In this invention, since the resilient contact plate and the electrical contact section are not formed as separate units, they can be integrally formed. The formation, as one part, of the resilient contact plate and the electrical contact section simplifies the part structure and thus permits an increase in the molding cycle and attempt to be made to decrease the cost.

Further advantages of this invention will be better understood from the following detailed description with reference to the accompanying drawings.

DESCRIPTION OF THE PREFERRED EMBODIMENT

Figure 1:
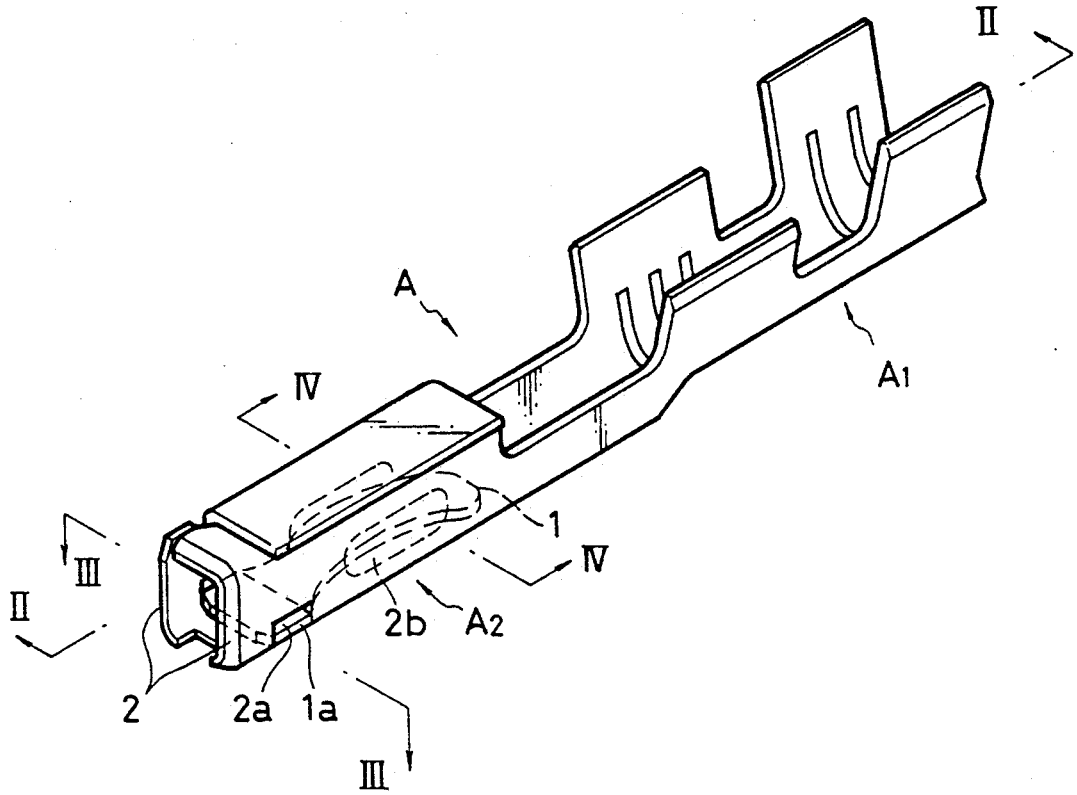
FIG. 1 is a perspective view of a socket contact in accordance with an embodiment of this invention.
Figure 2:
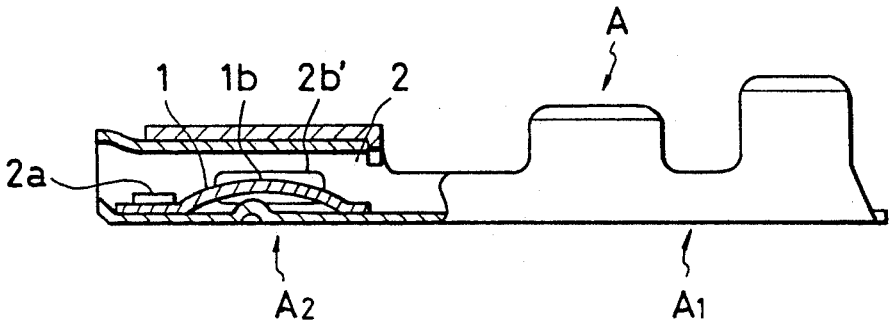
FIG. 2 is a sectional view taken along the line II—II of FIG. 1.

Referring to FIGS. 1 and 2, the socket contact A shown has a wire connection section A1 and a female electrical contact section A2 adapted to mate with a corresponding male contact having a flat configuration. The female electrical contact section A2 has a box-type body with its forward end open, in which is provided a resilient contact plate 1 formed of a highly resilient metal different from the material of this electrical contact section. The box-type body has opposing side walls 2 that have substantially flat exterior surface. The base portion of the resilient contact plate 1 has an engagement section 1*a* at each side end thereof, and these engagement holes 2*a* respectively formed by press work in the side walls 2 constituting the female electrical contact section A2.

Figure 4:
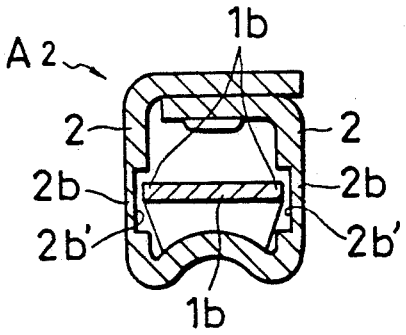
FIG. 4 is a sectional view taken along the line IV—IV of FIG. 1.
Figure 5:
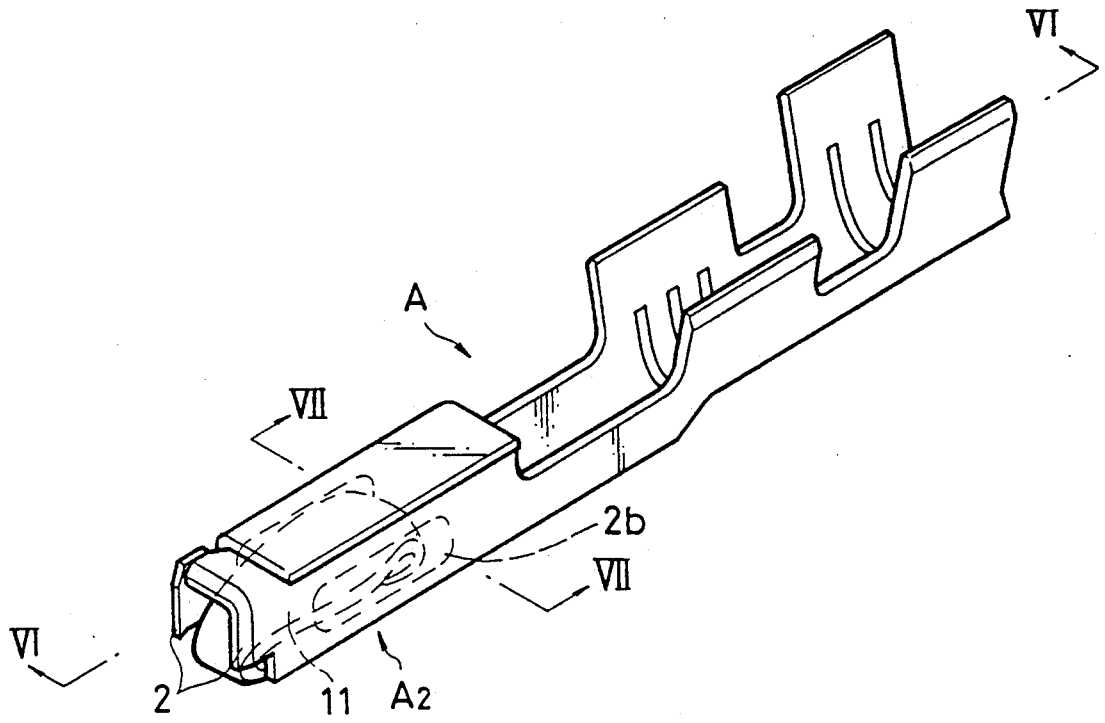
FIG. 5 is a perspective view of a socket contact in accordance with another embodiment of this invention.
Figure 6:
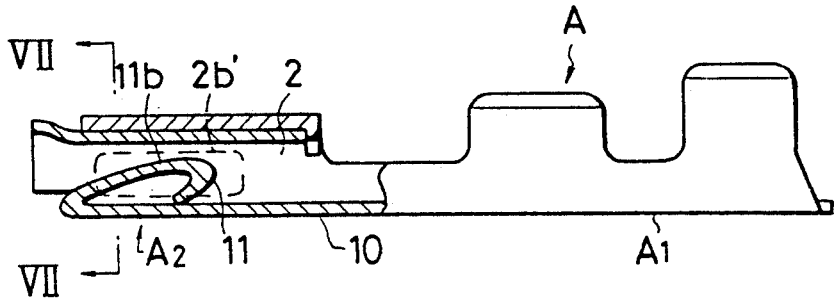
FIG. 6 is a sectional view taken along the line VI—VI of FIG. 5.

As shown in FIG. 4, formed in the respective middle sections as measured in the vertical direction of the side walls 2 are thin-walled sections 2*b* extending in the longitudinal direction, which thin-walled sections 2*b* provide on the respective inner surfaces of the side walls 2 recesses 2*b'* for inner-space enlargement.

Figure 3:
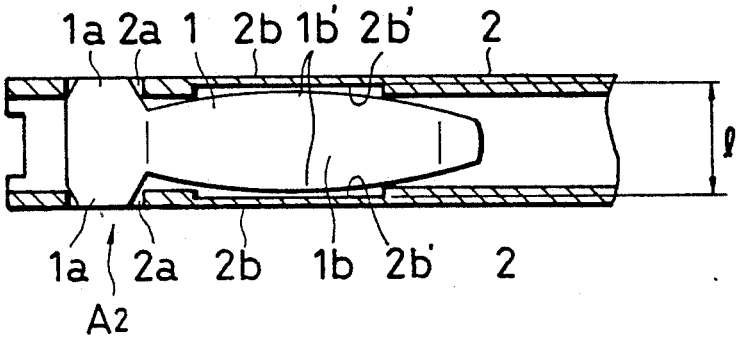
FIG. 3 is a sectional view taken along the line III—III of FIG. 1.

The width L of the main plate section 1*b* of the resilient contact plate 1 is such that it extends over the distance between the bottoms of the recesses 2*b'*, with the respective end edges 1*b'* of the main plate section 1*b* being respectively positioned in the recesses 2*b'* for inner-space enlargement in such a manner as to be resiliently displaceable. Thus, as shown in FIG. 3, the width L of the main plate section 1*b* can be made relatively large with respect to the width of the female electrical contact section A2.

An embodiment in which the resilient contact plate and the electrical contact section are integrally formed is described below with reference to FIGS. 5 to 8.

A socket contact A comprises a long thin plate in which a wire connection section and a female electrical contact section adapted to mate with a corresponding contact are formed. The female electrical contact section A2 has a bottom wall section 10 and opposing side walls 2 which respectively extend from both edges of the bottom wall section 10 in the substantially vertical direction. The bottom wall portion 10 extends beyond the side walls 2 and is backwardly bent to form a contact plate 11.

Figure 7:
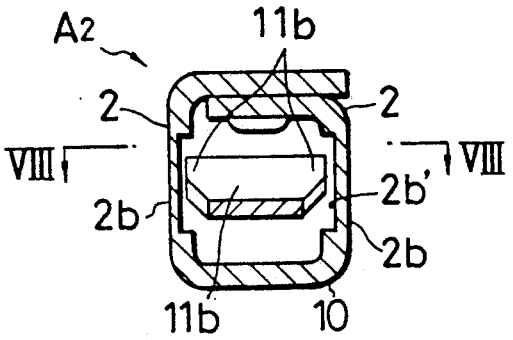
FIG. 7 is a sectional view taken along the line VII—VII of FIG. 5.
Figure 8:
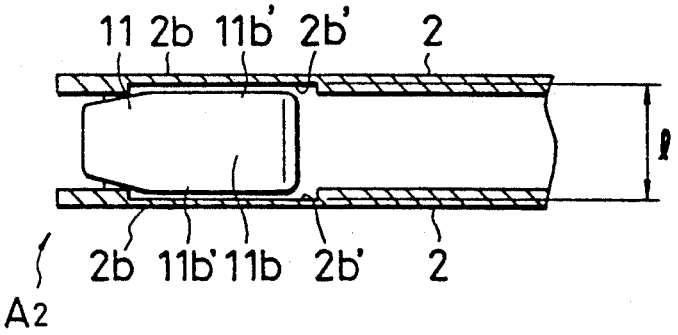
FIG. 8 is a sectional view taken along the line VIII—VIII of FIG. 7.

As shown in FIG. 7, thin-walled sections 2*b* are respectively formed by press work in middle sections of the side walls 2 in the vertical direction so as to extend in the longitudinal direction, and recesses 2*b'* are respectively formed in the inner surfaces of the side walls 2, whereby the space in the contact section can be enlarged.

The contact plate 11 has a main plate section 11*b* having a width L which extends over the distance between the recesses 2*b'*, the end edges 11*b'* thereof being respectively placed in the recesses 2*b'* so as to be displaceable. The contact plate 11 is further bent at a position of the main plate section 11 corresponding to the recesses 2*b'*. The width L of the main plate section 11*b* of the contact plate 11 can be set to a value greater than that of the female electrical contact section A2 in the same way as the above-described embodiment.

What is claimed is:

1. A female socket contact comprising a female electrical contact body having a bottom wall and opposing side walls and adapted to mate with a corresponding male contact, and a contact plate integrally provided on said bottom wall so as to extend from said side walls, formed by folding said bottom wall and having two opposing side edges, wherein each of said side walls of said female electrical contact body has a thin-walled section which defines a recess on an inner surface of said side wall so that the inner surface of said contact body is enlarged in a region near the recesses; and wherein portions of said side edges of said contact plate are respectively positioned in said recesses, and the width of said contact plate is enlarged between said portions of said side edges, the entirety of said contact plate being received and retained within said electrical contact body between said side walls and said bottom wall so as not to extend outside of said contact body.

2. a female socket contact according to claim 1, wherein said contact plate is bent at the front end of said wall portion and is formed so that it can be bent at a portion corresponding to said recesses of said side walls.

3. A female socket contact according to claim 1, wherein the exterior surface of said side walls is substantially planar.

4. A female socket contact, comprising;

an elongated plate in which are formed a wire connection section and a female electrical contact section adapted to mate with a corresponding contact, wherein said plate comprises a bottom wall, two opposing side walls upstanding therefrom, and a contact plate which is integrally formed along said bottom wall and is provided with side edges, said bottom wall, side walls and contact plate being foldable to form said female electrical contact section; and wherein said opposing side walls each have a thin-walled section which defines a recess on a side wall inner surface so that the interior of the female electrical contact section is enlarged in a region near the recesses;

wherein said side edges of said contact plate are received within said recesses and the entirety of said contact plate is received and retained within said female electrical contact section between said bottom wall and said side walls; and wherein the width of said contact plate is enlarged between the portions of said side edges.

5. A female socket contact according to claim 4, wherein the exterior surface of said side walls is substantially planar.

6. A female socket contact according to claim 4, wherein said side walls are extended from both edges of said bottom wall in the substantially vertical direction, and said thin-walled sections are respectively formed in the middle sections of said side walls in the vertical direction thereof so as to extend in the lengthwise direction.

7. A female socket contact according to claim 6, wherein said contact plate is bent backward at the front end of said wall section and is further bent at a position corresponding to said recesses formed in said walls.

* * * * *